US010773267B2

(12) United States Patent
Kurahashi et al.

(10) Patent No.: US 10,773,267 B2
(45) Date of Patent: Sep. 15, 2020

(54) DEVICE FOR FORMING AMORPHOUS FILM AND METHOD FOR FORMING SAME

(71) Applicant: Nakayama Amorphous Co., Ltd., Osaka (JP)

(72) Inventors: Ryurou Kurahashi, Osaka (JP); Hiroshi Matsumoto, Osaka (JP); Junji Takehara, Osaka (JP); Yoshihisa Fukutome, Osaka (JP)

(73) Assignee: USUI CO., LTD., Shizuoka (JP)

( * ) Notice: Subject to any disclaimer, the term of this patent is extended or adjusted under 35 U.S.C. 154(b) by 217 days.

(21) Appl. No.: 14/372,089

(22) PCT Filed: Jan. 10, 2013

(86) PCT No.: PCT/JP2013/050331

§ 371 (c)(1),
(2) Date: Jul. 14, 2014

(87) PCT Pub. No.: WO2013/105613

PCT Pub. Date: Jul. 18, 2013

(65) Prior Publication Data

US 2014/0335283 A1 Nov. 13, 2014

(30) Foreign Application Priority Data

Jan. 13, 2012 (JP) ..... 2012-005700

(51) Int. Cl.
*B05B 7/08* (2006.01)
*B05B 7/20* (2006.01)
(Continued)

(52) U.S. Cl.
CPC ..... *B05B 7/08* (2013.01); *B05B 7/1486* (2013.01); *B05B 7/1606* (2013.01); *B05B 7/20* (2013.01);
(Continued)

(58) Field of Classification Search
CPC .. B05B 7/08; B05B 7/20; B05B 7/201; B05B 7/205; C23C 4/129
See application file for complete search history.

(56) References Cited

U.S. PATENT DOCUMENTS 3,224,748 A * 12/1965 Buddenhagen ..... B05B 7/1486 266/51
4,192,460 A * 3/1980 Matsuo ..... B05B 7/205 239/419.3
(Continued)

FOREIGN PATENT DOCUMENTS

CN 101501236 A 8/2009
EP 2105532 A2 9/2009
(Continued)

OTHER PUBLICATIONS

European Search Report dated Mar. 22, 2016 in corresponding European patent application 13735785.1.
(Continued)

*Primary Examiner* — Dah-Wei D. Yuan
*Assistant Examiner* — Stephen A Kitt
(74) *Attorney, Agent, or Firm* — Bacon & Thomas, PLLC

(57) ABSTRACT

PROBLEM: To provide a large device and a method which is advantageous for forming a large-area amorphous film.
SOLUTION: A device of the invention sprays a flame including a particulate material with a spraying machine toward a substrate, melts the material with the flame, and cools the material and flame by cooling gas before they reach the substrate to form an amorphous film. The spraying machine has particulate material spraying ports and flame spraying ports such that the flame including the material has an oblong cross section. Inert gas spraying ports are successively placed on both sides across the ports of the material and flame. Mist spraying ports are successively placed on both sides across the ports for the material, flame
(Continued)

and inert gas. A skirt is attached/detached depending on a combustion gas or a film width to restrain film width narrowing and increase of film thickness deviation.

13 Claims, 7 Drawing Sheets

(51) Int. Cl.

| | |
|---|---|
| ***C23C 4/129*** | (2016.01) |
| ***C23C 4/08*** | (2016.01) |
| ***B05B 7/14*** | (2006.01) |
| ***B05B 7/16*** | (2006.01) |
| ***C23C 4/06*** | (2016.01) |

(52) U.S. Cl.
CPC ..... *B05B 7/201* (2013.01); *B05B 7/205* (2013.01); *C23C 4/06* (2013.01); *C23C 4/08* (2013.01); *C23C 4/129* (2016.01)

(56) References Cited

U.S. PATENT DOCUMENTS

| | | | | |
|---|---|---|---|---|
| 4,869,936 | A * | 9/1989 | Moskowitz | B05B 7/205 427/455 |
| 5,120,582 | A | 6/1992 | Browning | |
| 6,245,390 | B1 * | 6/2001 | Baranovski | B05B 7/203 219/76.14 |
| 2005/0199739 | A1 | 9/2005 | Kuroda et al. | |
| 2009/0246398 | A1 * | 10/2009 | Kurahashi | C23C 4/129 427/456 |

FOREIGN PATENT DOCUMENTS

| | | | |
|---|---|---|---|
| JP | S50111309 | U | 9/1975 |
| JP | S5351861 | Y2 | 12/1978 |
| JP | S5351862 | | 12/1978 |
| JP | S5588843 | A | 7/1980 |
| JP | S6320570 | B2 | 4/1988 |
| JP | H10507227 | A | 7/1998 |
| JP | 2003183805 | A | 7/2003 |
| JP | 2008043869 | A | 2/2008 |
| JP | 2008174784 | A | 7/2008 |
| JP | 2010022895 | A | 2/2010 |
| WO | 2010109223 | A1 | 9/2010 |

OTHER PUBLICATIONS

European Search Report for application No. 13735785.1 dated Sep. 10, 2015.
Chinese Search Report dated Jul. 3, 2015.

* cited by examiner

Relation between upstream water flow and sprayed substrate temperature

Relation between downstream water flow and sprayed substrate temperature

DEVICE FOR FORMING AMORPHOUS FILM AND METHOD FOR FORMING SAME

FIELD OF THE INVENTION

The present invention relates to a device and a method for forming an amorphous (non-crystalline; including metallic glass) film on the surface of a substrate (base material) by spraying, more specifically to a large device for forming a large-area amorphous film and a method for forming the film utilizing the device.

BACKGROUND OF THE INVENTION

A device disclosed in Patent Literature 1 below is one of means for forming an amorphous film on the surface of a substrate by thermal spraying. The device is outlined in FIG. 11, wherein:

A flame including a particulate (powdery) material is sprayed by a thermal spraying gun toward the substrate, while the flame melting the particulate material, and then the particulate material and the flame are cooled by a cooling gas before reaching the substrate.

A skirt for separating the flame from air is provided at a region in a path of the flame sprayed by the thermal spraying gun, where the particulate material melts (roughly, the early half of the flame), and a channel for the cooling gas is integrally structured with and along the skirt.

The thermal spraying gun is the same type as one used for powder flame thermal spraying and the cooling gas is one selected from nitrogen, inert gas, air, liquid-mist mixed gas and other gases.

The conventional device for forming an amorphous film, shown in FIG. 11, has following actions and effects:

The flame is cooled by the cooling gas before reaching the substrate, therefore, it is easy to make the particulate material amorphous, and it is possible to form an amorphous film on the substrate even with a metal having a high melting point and a narrow temperature range of supercooling.

As a high speed flame spraying process is not adopted, the particulate material stays in the flame for a longer time. As a result, it becomes easy to completely melt the particulate material. Also from this point of view, the device enables to form a film even with amorphous alloys, except metallic glass, which have a high melting point and a narrow temperature range of supercooling.

With a compact structure, the device is easy-to-handle and can achieve smooth on-site amorphous film formation.

CITATION LIST

Patent Literature

PLT 1: JP4579317B

SUMMARY OF THE INVENTION

Technical Problem

While the aforementioned conventional device is advantageous in forming a high quality amorphous film with various alloys including metallic glass, it may not efficiently form a large-area amorphous film. This is because, in general the width of a film formed by a flame of about 30 mm in diameter is no more than about 7 mm, therefore, in order to form a large-area film, the device has to repeatedly reciprocate in a neighborhood area on the substrate.

Conducting thermal spraying many times to the neighborhood area on the substrate with the reciprocating device may raise the temperature of the substrate. Therefore, moving speed and time interval of the reciprocating device, cooling of the substrate, or the like have to be properly controlled. This may lead to failure in smooth formation of an amorphous film. Moreover, a larger flame with a wider cross section certainly enables a large-area thermal spraying though, the flame temperature or the like in the cross section may become inhomogeneous. This may increase difficulty in productive formation of a high quality, homogeneous amorphous film for industrial use.

The object of the present invention is, based on these viewpoints, to provide a large device, etc. which is advantageous to form a large-area amorphous film.

Solution to Problem

A device for forming an amorphous film according to the invention, which sprays a flame including a particulate material with a spraying machine toward a substrate, melts the particulate material with the flame, and cools the particulate material and the flame with a cooling gas before the particulate material and the flame reach the substrate, is characterized as mentioned below. The device is outlined in FIG. 1. That is:

a) The spraying machine has a front side provided with a series of particulate material spraying ports and a series of flame spraying ports each placed along a straight line (hereinafter, "a series of spraying ports" means a plurality of spraying ports tightly disposed at small intervals, or a spraying port provided as a slit aperture) such that the flame including the particulate material has an oblong cross section (in other words, a cross section larger in one direction than in the other direction at right angles to each other: a longitudinally-long cross section or a laterally-long cross section when viewed from a different direction).

b) A series of spraying ports of an inert gas (including nitrogen) for rectification and cooling of the flame (the flame including the particulate material) is placed along the straight line, on both sides across all of the series of particulate material spraying ports and the series of flame spraying ports.

c) A series of spraying ports of a mist (fluid mist such as water mist) for cooling of the flame (the flame including the particulate material) is placed along the straight line, on both sides across all of the series of particulate material spraying ports, the series of flame spraying ports, and the series of inert gas spraying ports.

The device has the following actions and effects.

Like the conventional device shown in FIG. 11 (PLT 1), cooling the flame with the cooling gas before the flame reaches the substrate, the device enables to make the particulate material amorphous and form an amorphous film on the substrate even with a metal having a high melting point and a narrow temperature range of supercooling. The device also enables to form a metallic glass film.

Since the device is large and the flame including the particulate material has an oblong cross section, it is possible to form a large-area amorphous film on the substrate only by transferring the device (or the substrate) one or a few times to right angles to the longitudinal direction of the cross section. Since the cross section of the flame has a larger size only in one direction, unlike the case having a larger diameter or the like, the temperature variation is not easy to occur in the cross section. This facilitates the realization of homogeneous film formation.

A jet flow of the inert gas for rectification and cooling is formed on both sides of the flame including the particulate material, and further a jet flow of the mist for cooling is formed on both sides thereof. Generally, when the flame is not rectified, the particulate material flows turbulent to fail to properly reach the substrate, and air is involved in the flame to lower quality of the amorphous film. Moreover, when the flame is not sufficiently cooled, the cooling rate of the particulate material becomes insufficient for amorphization. When the jet flow of the inert gas and the mist is formed as mentioned above, rectification and cooling are properly and sufficiently performed.

However, the proper and sufficient rectification and cooling of the flame is performed only by using both of the inert gas and the mist as mentioned above. The flow of the inert gas alone or the flow of the mist alone cannot desirably perform rectification and cooling. That is, the flame has a stronger power than the conventional one as getting larger to have an oblong cross section and an increasing inert gas lowers a cooling efficiency, therefore it is difficult to sufficiently cool such a flame only by the inert gas flowing outside of the flame. On the other hand, to flow the mist alone causes failure in rectification of the flame because the phase change and chemical change of the mist may occur, thereby disturbing the flame. Only by flowing the inert gas closely outside the flame to rectify and partially cool the flame and further flowing the mist outside and inside thereof to strongly supplement cooling of the flame, proper and sufficient rectification and cooling of the flame are performed.

In the device of the invention, preferably the series of mist spraying ports is set at an angle such that a sprayed mist approaches the flame (that is, the mist sprayed from either sides crosses each other at a forward position), and the angle is able to be changed.

When the angle of the series of mist spraying ports is thus determined such that the sprayed mist approaches the flame including the particulate material from both sides across the flame, the mist surely comes in contact with the flame, thereby enabling the aforementioned sufficient cooling.

Moreover, when the angle of the series of mist spraying ports is able to be changed, it is possible to adjust strength for cooling the flame. The device of the invention is required to form amorphous films with various alloys on the substrate by changing chemical components of the particulate material. Some alloys need rapid quenching in particular and other alloys like metallic glass become non-crystalline by a comparatively low cooling rate. When the angle of the series of mist spraying port is able to be changed to adjust the cooling strength as described above, it is possible to form an amorphous film with the variety of alloys. The change of the angle also enables to change (the lateral length of) the cross section of the flame, thereby controlling the thickness and properties (including amorphization rate) of an amorphous film to be formed.

It is more preferable that a spray pressure of the inert gas and a spray pressure of the mist are able to be changed respectively.

When the spraying pressure is able to be changed, it is possible to adjust the strength for rectification and cooling of the flame. Accordingly, further advantageously, an amorphous film with a variety of alloys is properly formed on the substrate. For example, a higher inert gas pressure and a lower mist pressure decrease the cooling strength, and a lower inert gas pressure and a higher mist pressure increase cooling strength. In the latter case, when the angle of the mist is tilted close to the flame, the mist remarkably comes in contact with the flame, thereby increasing cooling strength for the flame.

In the device of the invention, it is more preferable that the mist is a water mist; and when the mist is sprayed, a quantity of oxygen supplied to and sprayed from the series of flame spraying ports is 50 to 80% of oxygen requirements for complete combustion.

A water mist is the most inexpensive as the mist and has a superior cooling effect. But the water mist often decomposes into oxygen and hydrogen by a contact with the flame, thereby generating an excessive amount of oxygen in the flame.

In the device of the invention, since the flame has a stronger power than that of general thermal spraying guns as getting large, the water mist easily decomposes to generate oxygen in the flame to an excessive amount, thereby producing oxides in the amorphous film. This is the reason of reducing a quantity of oxygen sprayed from the series of flame spraying ports into 50 to 80% of oxygen requirements for complete combustion as described above (for example, this is carried out with propane gas to obtain a reducing flame). Thus, oxygen is prevented from excessively generating in the flame, thereby enabling to form on the substrate an amorphous film including no (or less) oxides generated by reaction of the flame and the material. Moreover, an oxide originally existing in the material is also reduced. As a result, an amorphous film including fewer oxides is formed. The quantity of oxygen sprayed from the series of flame spraying ports is appropriately determined in the range from 50 to 80% depending on the amount of sprayed water mist, the flame temperature or the like.

In the device of the invention, preferably the inert gas and the mist are able to be sprayed so as to cool the flame including the particulate material at a rate of 400,000 to 1,000,000° C./s.

This is because cooling the flame including the particulate material at this rate enables to make the particulate material melted in the flame amorphous to coat the substrate. But, even when cooling is not conducted at the rate, it is possible to form on the substrate a film with metallic glass or the like.

In the device of the invention, preferably, the series of particulate material spraying ports is structured by successively disposed particulate material spraying ports, which are symmetrical about a virtual plane located on a center of the spraying machine (that is, a center of the series of particulate material spraying ports) at right angles to the "straight line"; and the particulate material is fed to the particulate material spraying ports from a plurality of supply pipes through branched passages, the supply pipes being capable of adjusting each of the particulate material supply and the carriage gas flow rate (in each supply pipe, it is possible to adjust the supply and the gas flow rate respectively), the branched passages being symmetrically formed about the virtual plane and having an equal passage length from (a lower end of) the supply pipes to each of the particulate material spraying ports.

In the device of the invention, in which the flame has an oblong cross section, the particulate material has to be homogeneously fed and sprayed without any deflection and variation of a sprayed amount of the particulate material at every part in the cross section of the flame. In the structure described above, i) the particulate material spraying ports are symmetrically disposed about the center part of the spraying machine; ii) the particulate material supplying passages to each particulate material spraying port are branched passages symmetrically formed about the center part and having an equal length; and iii) the particulate material is supplied from the supply pipes which are capable of adjusting each of particle supply and carriage gas flow rate, to the spraying ports through the supplying passages. Such a structure enables to symmetrically spray the particulate material to the oblong flame without deflecting to either side (either of right and left) of the longitudinal direction of the flame, and further enables to adjust the material supply (i.e. spray amount) through each of the supply pipes. Therefore, homogeneous spraying of the particulate material is achieved at every part in the cross section of the flame. For further homogeneous spraying, each spraying port can have a different size and the branched passage can have a partially decreased inner diameter. Such a device is outlined in FIG. 2, for example.

Preferably the series of mist spraying ports is provided as a slit aperture extending along the straight line (i.e., the straight line along which the series of particulate material spraying ports and the series of flame spraying ports are disposed).

The series of mist spraying ports can also be a plurality of mist spraying ports successively disposed like the series of particulate material spraying ports. However, when the series of mist spraying ports are provided as a slit aperture, the mist has a less chance to strike against an inside wall of the spraying port. Therefore, advantageously the sprayed mist tends to remain microscopic in size, and substantially comes in contact with the flame in a larger area, thereby cooling the flame more efficiently.

It is also preferable that the device of the invention has a skirt provided around and extending to a forward position of all of the series of particulate material spraying ports, the series of flame spraying ports, and the series of inert gas spraying ports, which can be removable.

Since pressures and flow rates of the material, the flame and the inert gas sprayed from the device decrease through contact with air, a formed film could have a narrow width (width narrowing) and a large thickness deviation (see FIG. 10(*a*)). But in the case the device has a skirt as described above, the material, the flame and the inert gas come in contact with air in a smaller area, thereby restraining film width narrowing and increase of film thickness deviation (see FIG. 10 (*b*)) This is advantageous for forming a wide and homogeneous amorphous film.

But, film width narrowing and increase of film thickness deviation may vary depending on an amount of combustion gas to be used in the device, a width of a film to be formed, and the like. Therefore, it is desirable that the skirt is attachable and detachable according to a condition of film formation.

The device of the invention can have a structure such that the flame including the particulate material has a cross section of 150 mm or more in longitudinal length (about 300 mm, for example, while the lateral length of the cross section is about 30 mm, for example), and the series of inert gas spraying ports and the series of mist spraying ports each formed along the straight line are also 150 mm or more in length (about 300 mm, for example; also in length between both ends of a plurality of spraying ports, when the ports are tightly and successively placed).

When the device is large to have such a flame with an oblong cross section, it is possible to efficiently form a large-area amorphous film on the substrate. Additionally for the sake of amorphous film formation, such a large device needs an inert gas flow just outside the flame for rectification and partial cooling of the flame and also needs a mist flow still outside the inert gas for strongly supplementing the cooling of the flame as described above, therefore the present invention is remarkably significant.

A method for forming an amorphous film according to the invention is characterized by utilizing the device for forming an amorphous film and changing the angle of the series of mist spraying ports and the spray pressure of each of the inert gas and the mist, depending on chemical components of the particulate material (consequently, of an amorphous film to be formed).

In this method, a film of various amorphous alloys which are different in chemical components or the like is properly formed. Because, changing the angle of the series of mist spraying ports or the spray pressure of the inert gas and the mist enables to rectify the flame including the particulate material and appropriately adjust cooling strength.

Effects of the Invention

According to the present invention, it is possible to efficiently form a large-area, homogeneous and high-quality amorphous film. It is possible to form an amorphous film of various alloys including a metal with a high melting point and a narrow temperature range of supercooling, and metal glass.

BRIEF DESCRIPTION OF THE DRAWINGS

FIG. 1(*a*) is a front view of the device 1 (a cross sectional view taken along line a-a in FIG. 1(*b*)); FIG. 1(*b*) is a side view (also showing a flame or the like during film formation); and FIG. 1(*c*) is a bottom view.

FIG. 5 shows a graph of a flame temperature distribution from the front side of the spraying machine to the spray object, and a photograph of externals of the sprayed flame or the like.

DESCRIPTION OF EMBODIMENTS

Figure 1:
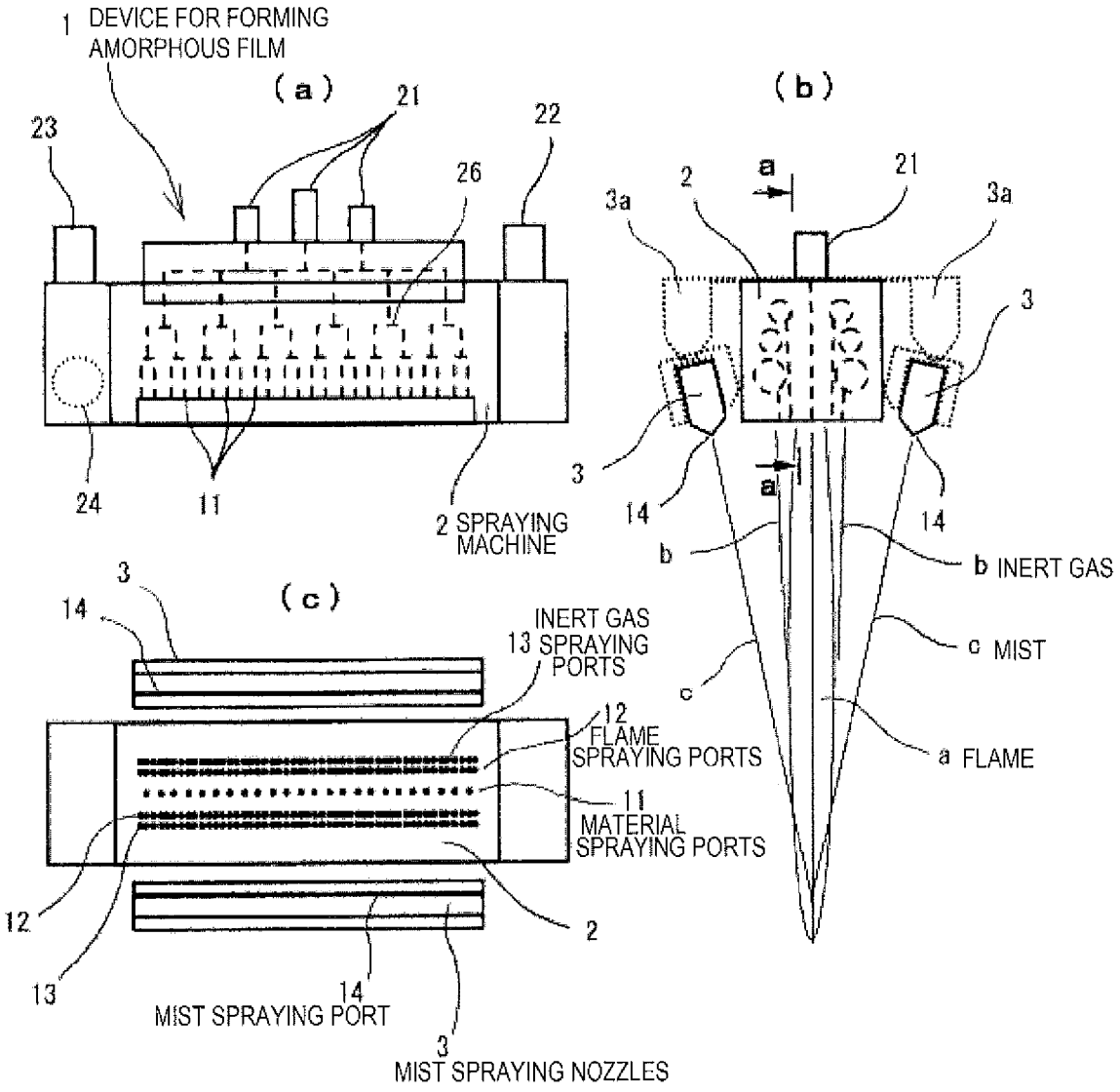
FIG. 1 shows a device for forming amorphous film 1 according to the invention.
Figure 11:
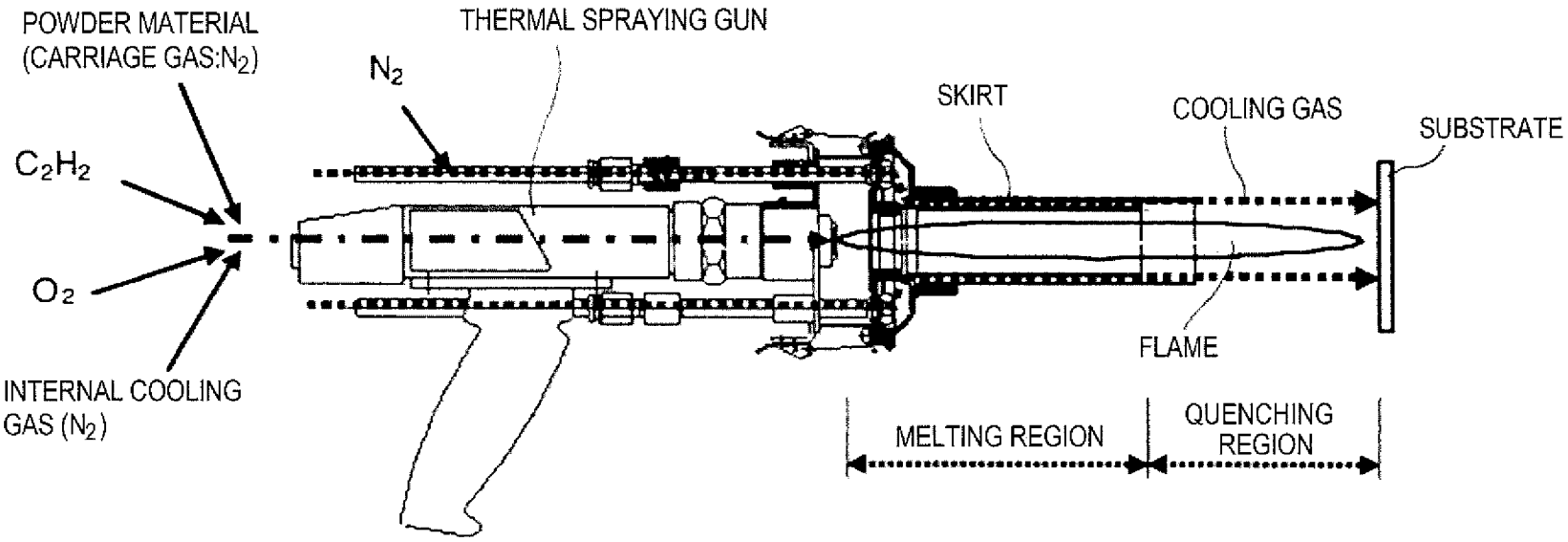
FIG. 11 shows a conventional device for forming amorphous film.

FIG. 1 shows a device for forming amorphous film 1 according to the invention. The device 1 is capable of spraying a flame a about 300 mm in width to achieve an industrial formation of a large-area amorphous film having a corresponding width. Theoretically, according to a powder flame spraying method like the conventional device shown in FIG. 11, the device 1 sprays the flame a including a particulate material to a substrate (not illustrated; placed a downward position in FIG. 1(*a*) and transferred) with a spraying machine 2, melts the particulate material with the flame a, and cools the particulate material and the flame before they reach the substrate, thereby forming a non-crystalline film.

In detail, the device 1 is structured as follows.

The spraying machine 2 has a front side provided with a series of particulate material spraying ports 11 and a series of flame spraying ports 12, in both series a plurality of ports being disposed at small intervals along a common straight line extending to the longitudinal direction of the spraying machine 2, such that the flame a including the particulate material has an oblong cross section of about 300 mm in longitudinal direction.

Further a series of inert gas (nitrogen gas) spraying ports 13 is provided on both sides across all of the particulate material spraying ports 11 and the flame spraying ports 12, a plurality of ports 13 being also disposed at small intervals along the straight line, for rectification and cooling of the flame a including the particulate material.

On both sides across the spraying machine 2 including the particulate material spraying ports 11, the flame spraying ports 12 and the inert gas spraying ports 13, spraying nozzles 3 of mist (water mist) for cooling of the flame are disposed. The spraying nozzles 3 have a downwardly directed mist spraying port 14. The spraying port 14 is a slit which is continuously open along the straight line.

As shown in FIG. 1(*b*), the mist spraying nozzles 3 are provided on the spraying machine 2 via a support member 3*a* connected to the spraying machine 2. The spraying nozzles 3 are provided on the support member 3*a* at an inward inclined angle, such that a sprayed mist from either sides of the spraying machine 2 approaches the flame a to cross each other at a forward position of the flame a, and the angle is able to be changed. The inert gas spraying ports 13 are also set at an inward inclined angle, such that the sprayed inert gas b approaches the flame a. However, in order to strengthen cooling effect, usually the mist c is sprayed at a larger angle than the inert gas b so as to enter into the flame a.

The reference numeral 21 in FIG. 1 indicates a supply pipe (three in total) for supplying the particulate material together with carriage gas (nitrogen gas, and the like). The particulate material is fed from the supply pipes 21, disposed through branched passages 26 formed in the spraying machine 2, and sprayed from each material spraying port 11. Each of the reference numerals 22 and 23 indicates supply pipes for oxygen and propane gas as fuel for the flame a respectively. The reference numeral 24 indicates a supply pipe for the inert gas b for rectification and cooling of the flame (a supply pipe for the mist is not illustrated). Each supply per hour through the supply pipes is able to be changed, and each of the inert gas spray pressure and the mist spray pressure is able to be changed. Because the flame a is wide and strong, the sprayed mist is decomposed to generate oxygen. Therefore, in order to avoid oxygen in the flame a becoming excessive, a quantity of oxygen fed to the supply pipe 22 is restricted to 50 to 80% of oxygen requirements for complete combustion of fuel gas.

As described above, the flow and the pressure of each gas, the particulate material and the like, and the spraying angle of the mist c are respectively changed. Therefore, the device 1 enables to appropriately adjust the cooling rate of the flame a. The adjustment is conducted depending on chemical components of the alloy (that is, chemical components of the particulate material) to be sprayed and the like: when spraying metallic glass or the like, slower cooling rate is applied; and when spraying a metal having a high melting point and a narrow temperature range of supercooling, the cooling rate is raised to about 400,000 to 1,000,000° C./s.

Forming an amorphous film on a substrate with the device 1 is conducted by, for example, feeding a belt-like thin substrate to a fixed, horizontal direction and spraying to the surface of the substrate with the device 1 spaced a few hundred mm above the substrate. When the width (or longitudinal) direction of the device 1 is set at right angles to the feeding direction of the substrate, the device 1 is able to efficiently form a large-area amorphous film of about 300 mm in width.

Figure 2:
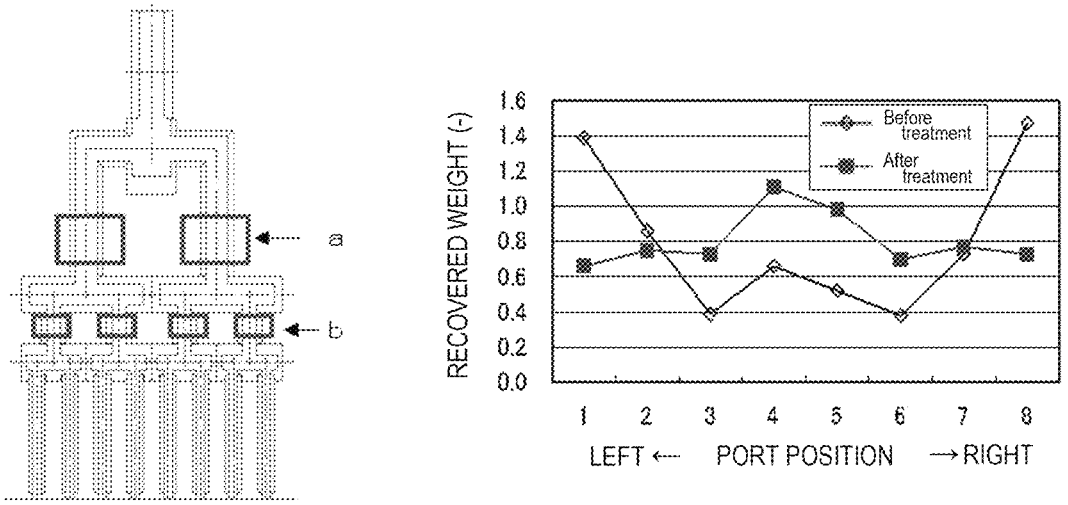
FIG. 2 shows a schematic diagram of branched passages of supply pipes for particulate material in the device of the invention and a graph of a distribution of sprayed amount from each spraying port (outlet port).

A schematic diagram in FIG. 2 shows the particulate material supply pipes 21 and the branched passages 26 connected thereto in the device 1, regarding one of the three supply pipes. The graph shows a weight of the particulate material recovered at each particulate material spraying port, when the particulate material and carriage gas are fed from upstream. The supply pipes from upstream to the spraying ports have a structure such that the spraying ports are symmetrically disposed on both sides across the center part of the spraying machine, and that the particulate material supplying passages to the spraying ports are the branched passages having an equal length and symmetrically formed on both sides across the center part. Thus, as the graph shows, the particulate material is symmetrically sprayed without deflecting to one side in the longitudinal direction (that is, the right side or the left side). For further homogeneous spraying, a treatment to decrease the inner diameter of the branched passages at the part a and the part b in the schematic diagram are adopted. The result of the treatment is shown in the graph as "after treatment", which shows that a variation of spraying amount is eliminated.

Hereinafter, various measurements regarding the device for forming amorphous film according to the invention (device 1 of FIG. 1) are introduced.

Figure 3:
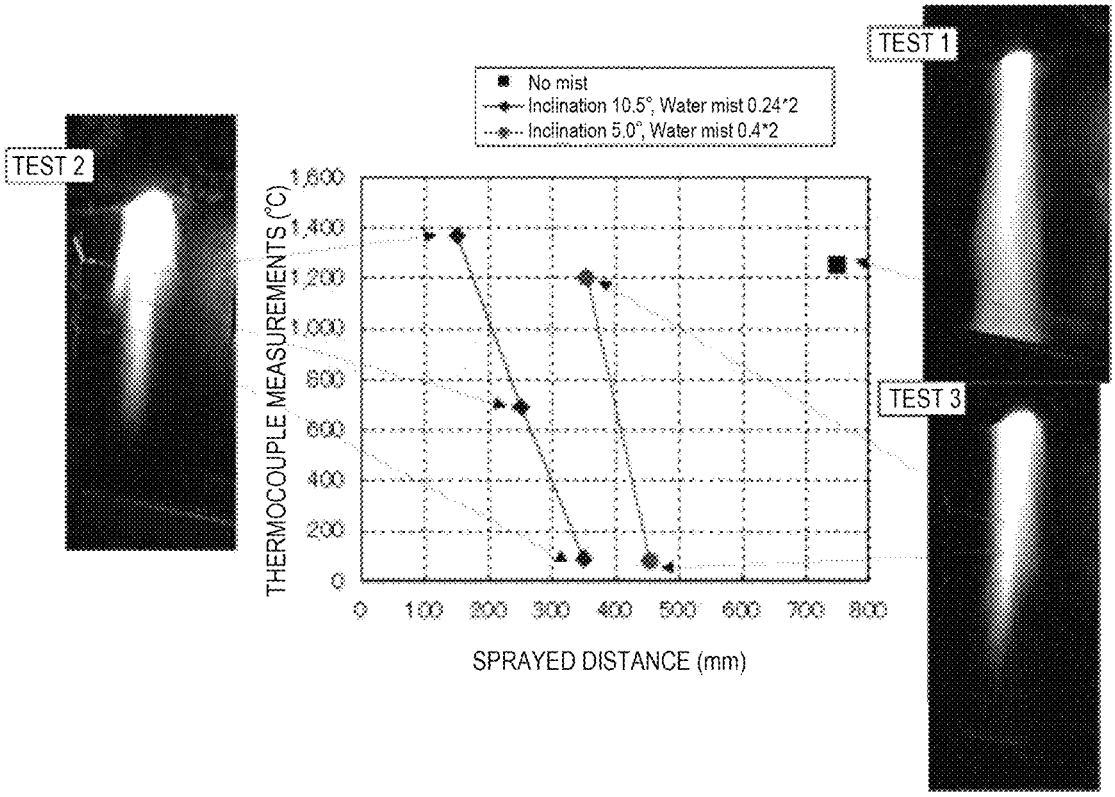
FIG. 3 shows photographs and a graph of temperature measurements of the flame sprayed by the device of the invention.

FIG. 3 shows a result of temperature measurement of the flame sprayed by the device of the invention. Each photograph of FIG. 3 shows a sprayed flame, and in test 2 and test 3, the mist (water mist for cooling the flame) is sprayed together with the flame. The horizontal axis of the graph shows the sprayed distance from the front side of the spraying machine. The flame temperature is measured at sprayed distances of 750 mm in test 1, 150 mm, 250 mm and 350 mm in test 2, and 350 mm and 450 mm in test 3 for comparison. The graph shows a temperature distribution of the sprayed gas based on the temperature measurements. The sprayed gas temperature exceeded 1,200° C. at the sprayed distances of 750 mm in test 1, 150 mm in test 2, and 350 mm in test 3. In test 2 and test 3, the sprayed gas was cooled down to 100° C. as a result of cooling. But, since the water mist spray pressure and the mist spraying angle were changed, forms and temperature distributions of the sprayed gas assume a different aspect. The sprayed length, in which the temperature declined from 1,200 to 100° C., was 100 mm in test 3. Because the gas was sprayed at the rate from 30 to 100 m/s, it is found that the cooling rate of the sprayed gas was 300,000 to 1,000,000° C./s in this case.

Figure 4:
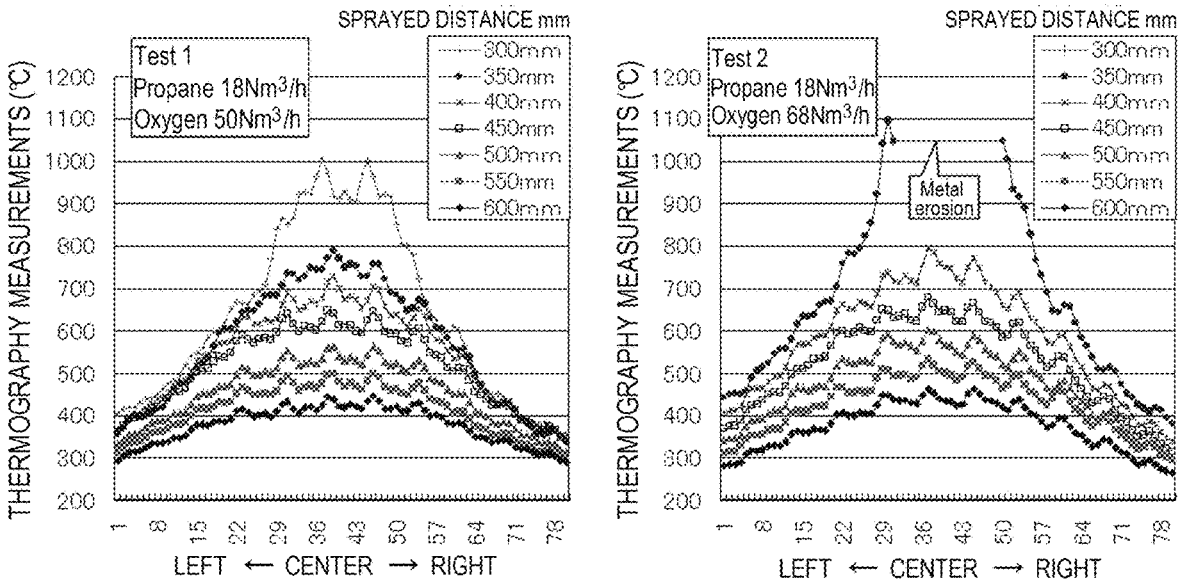
FIG. 4 shows graphs of a flame temperature distribution from the front side of the spraying machine to a spray object.

FIG. 4 shows a distribution of the flame temperature between the front side of the spraying machine and the spray object. The both graphs show a comparison of temperatures at the sprayed distances from the front side of the spraying machine of 300 mm, 350 mm, 400 mm, 450 mm, 500 mm, 550 mm and 600 mm. Condition for spraying was changed from 50 $Nm^3/h$ of oxygen flow to 68 $Nm^3/h$ of oxygen flow. Both graphs show a temperature distribution of the sprayed gas on a straight line parallel to the front side of the spraying machine. In the case of the oxygen flow of 50 $Nm^3/h$, the temperature near the center was about 1,000° C. at the sprayed distance of 300 mm, while in the case of the oxygen flow of 68 $Nm^3/h$, the temperature at the center was as high as the spray object melts (1,200° C. or more) at the sprayed distance of 350 mm, and was about 700° C. at the sprayed distance of 400 mm. The graphs clearly show that the temperature of the sprayed gas gradually declines depending on the distance.

Figure 5:
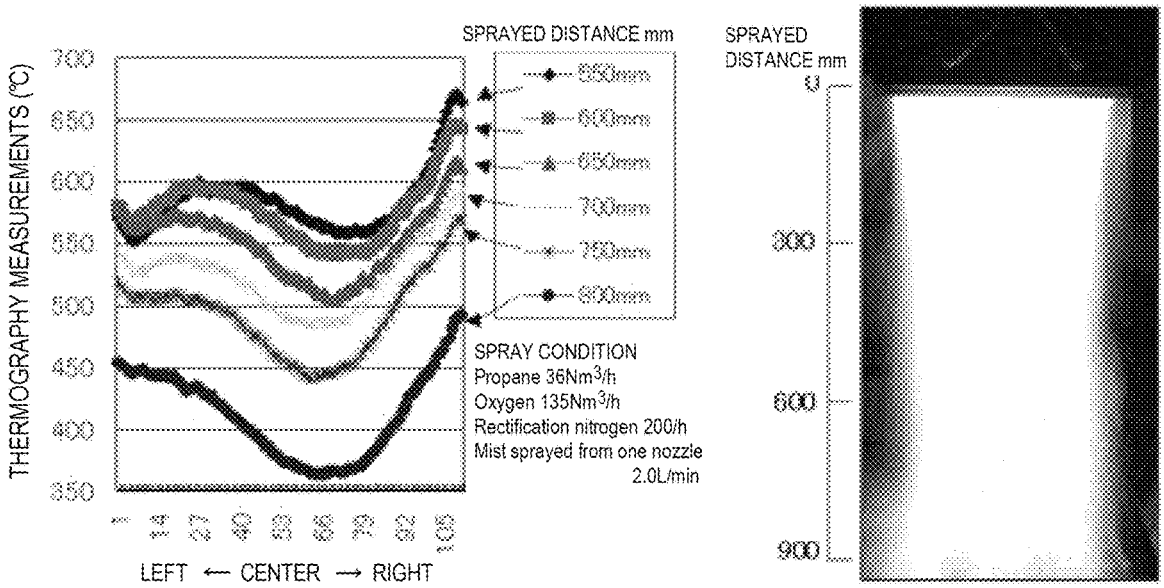

FIG. 5 shows a temperature distribution of the flame between the front side of the spraying machine and the spray object, and an appearance photograph of the flame. In the photograph, the sprayed distance of 0 mm indicates the front side of the spraying machine. The graph shows a comparison at the sprayed distances from the front side of 550 mm, 600 mm, 650 mm, 700 mm, 750 mm and 800 mm. The graph shows the temperature distribution of the sprayed gas on a straight line parallel to the front side of the spraying machine. It is found that at the sprayed distance of 550 mm, the temperature distribution is in a range from 550 to 600° C., almost homogeneous, however, as the distance becomes larger, the sprayed gas temperature becomes lower and the temperature range becomes larger.

Figure 6:
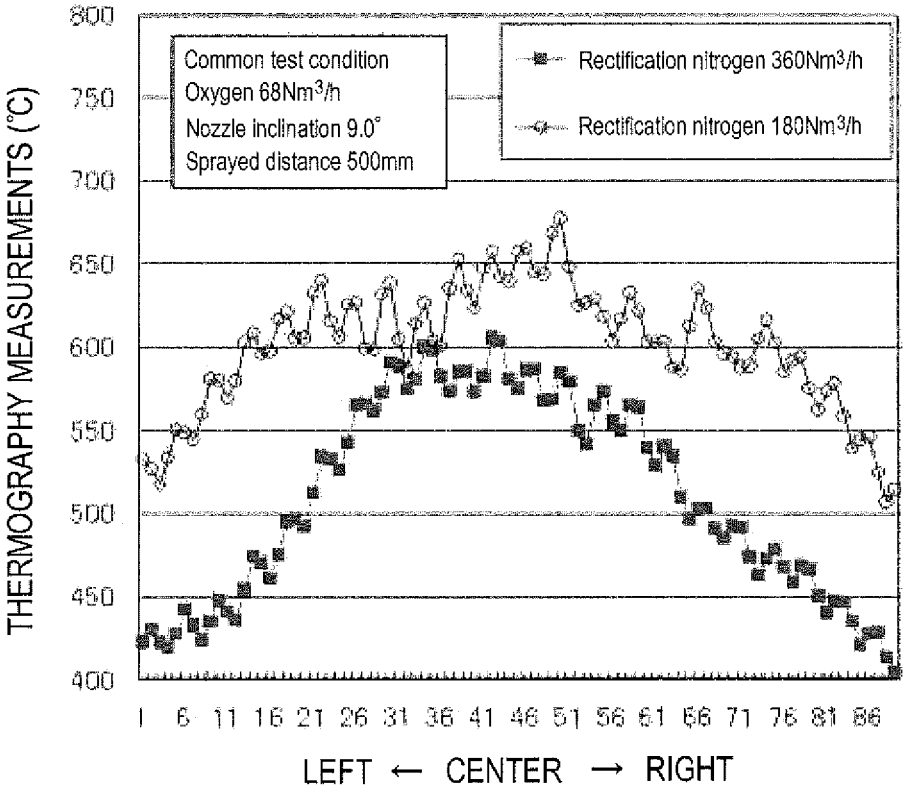
FIG. 6 is a graph of a flame temperature distribution, when the inert gas is used.

FIG. 6 shows a temperature distribution of the flame at the sprayed distance of 500 mm, when the inert gas (for rectification and cooling of the flame) is nitrogen gas. Under a fixed spray condition, the spray pressure of the inert gas was changed for comparison. As a result of changing the spray pressure of the inert gas, the flow rate was 360 $Nm^3/h$ and 180 $Nm^3/h$. The graph shows a temperature distribution of the sprayed gas on a straight line parallel to the front side of the spraying machine. It is found that the change of the inert gas spray pressure adjusted the cooling strength to have an effect on the sprayed gas temperature distribution by 50 to 100° C. in this case.

Figure 7:
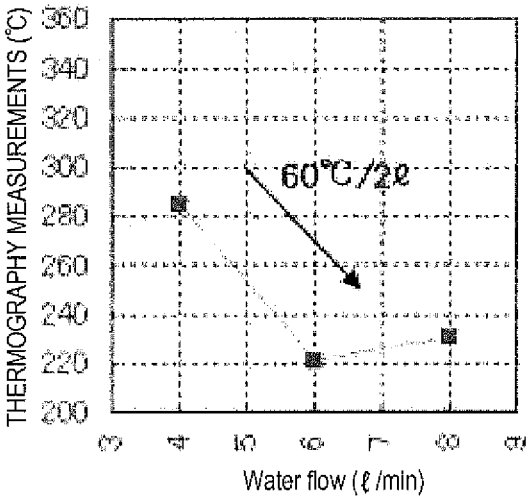
FIG. 7 shows graphs of a temperature distribution of the spray object, when the water mist is used.
Figure 7:
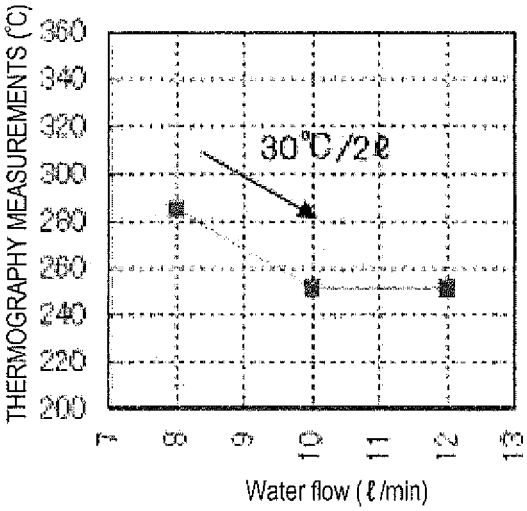

FIG. 7 shows a temperature distribution of the spray object at the sprayed distance of 400 mm, when the mist (for cooling the flame) is water mist. Under a fixed spray condition, the spray pressure of water mist was changed for comparison. The spray object was a surface of a thin plate substrate, and the particulate material was 80Ni-20Cr. As a result of changing the water mist pressure, the upstream water mist flow rate alone was changed to 4 l/m, 6 l/m and 8 l/m, or the downstream water mist flow rate alone was changed to 8 l/m, 10 l/m and 12 l/m. Both graphs show a temperature at a part where the sprayed gas hit on the thin plate substrate. It is found that the change of the water mist spray pressure adjusted the cooling strength to have an effect on the temperature of the thin plate substrate by 30 to 60° C. to the maximum for every 2 l/m.

The aforementioned terms "upstream" and "downstream" are defined to be upstream side or downstream side along the feeding direction of the substrate as the spray object in the device of the invention (the substrate transferred relative to the device of the invention).

EXAMPLE

Hereinafter, the test production of an amorphous alloy thin plate conducted by utilizing the device of FIG. 1 is described. In the test, a rolling mill and the like were also used as mentioned below.

(1) Test Method

A rapid quenching transition control spraying machine (the device for forming amorphous film shown in FIG. 1) is used to product an amorphous alloy thin plate of 300 μm in thickness and 300 mm in width. The production test was conducted by a rapid quenching transition control spraying machine provided on a test rolling mill. A test condition of the rapid quenching transition control spraying machine is shown in Table 1. The amorphous alloy thin plate was produced by heating the surface of the thin plate substrate to 400° C. in temperature before spraying an amorphous alloy, melting 64.5Ni-10Cr-7.5Mo-18B powder, spraying from the rapid quenching transition control spraying machine to form an amorphous alloy film, keeping the film in a temperature range of plastic flow (300 to 520° C.), while removing an inner hole and rolling to flatten the surface of the film, and then peeling off the film from the substrate.

TABLE 1

Table 1 Test condition for producing amorphous alloy thin plate

| | | |
|---|---|---|
| Condition of large-size rapid quenching transition control spraying | Alloy powder supply (g/s) | 30 |
| | Propane gas flow rate ($m^3/h$) | 34 |
| | Oxygen flow rate ($m^3/h$) | 120 |
| | Rectifying nitrogen flow rate ($m^3/h$) | 400 |
| | Sprayed distance to the thin plate substrate (mm) | 600 |
| | Angle of upstream water mist (°) | 9 |
| | Flow rate of upstream water mist (l/min) | 4 |
| | Angle of downstream water mist (°) | 9 |
| | Flow rate of downstream water mist (l/min) | 4 |

(2) Test Result

Figure 8:
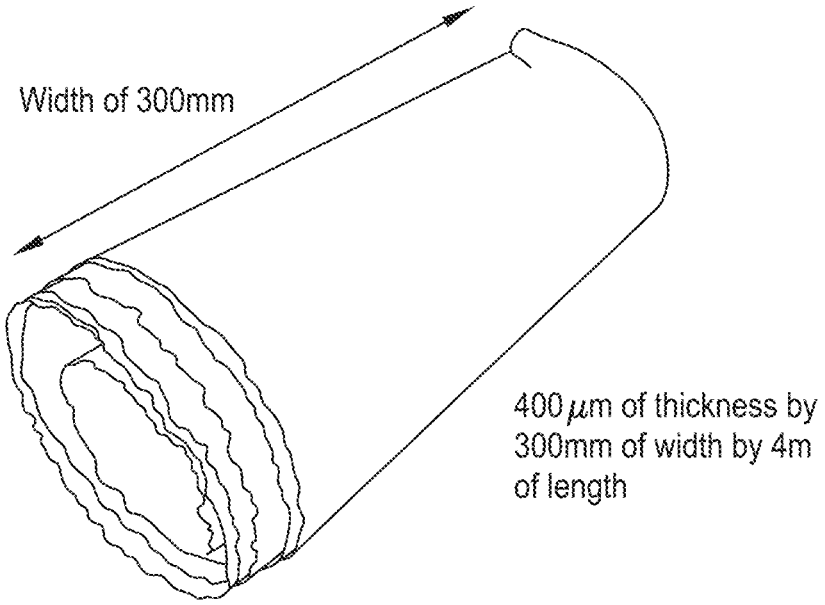
FIG. 8 is a photograph of externals of an amorphous alloy thin plate obtained by a production test.
Figure 9:
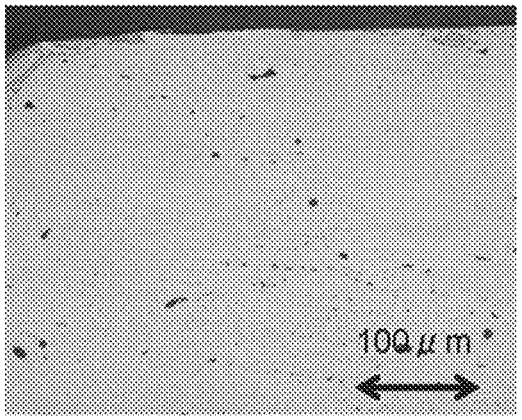
FIG. 9 shows a cross sectional photomicrograph of the amorphous alloy thin plate, and a result of X-ray diffraction profile for the thin plate.
Figure 9:
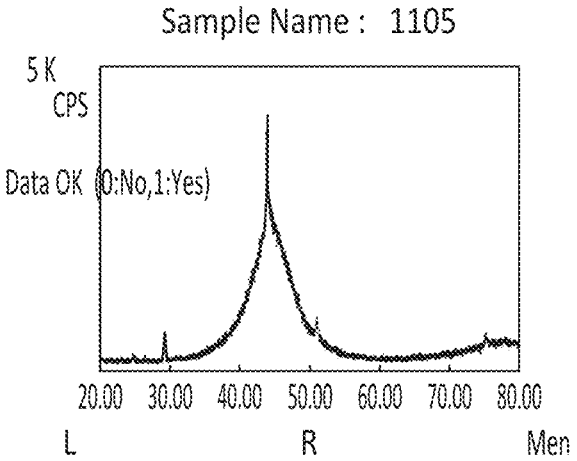

The appearance of the amorphous alloy thin plate obtained by the production test is shown in FIG. 8. The obtained amorphous alloy thin plate was a successive belt of 400 μm in thickness, 300 mm in width and 4,000 mm in length. The cross section of thus obtained amorphous alloy thin plate and the X-ray diffraction profile result are shown in FIG. 9.

In the aforementioned rapid quenching transition control spraying machine (the device 1 for forming amorphous film shown in FIG. 1), depending on the flow rate of combustion gas or the size of the formed film or the like, the flame a and the inert gas b are occasionally desired to come in contact with air in a smaller area. Specifically, the spraying machine 2 is desirable to have a front part provided with a skirt having a rectangular, hollow cross section and placed around, extending forward all of the flame spraying ports 12 and the inert gas spraying ports 13, which is indicated by the referring numeral 6 in FIG. 10(*b*).

Figure 10:
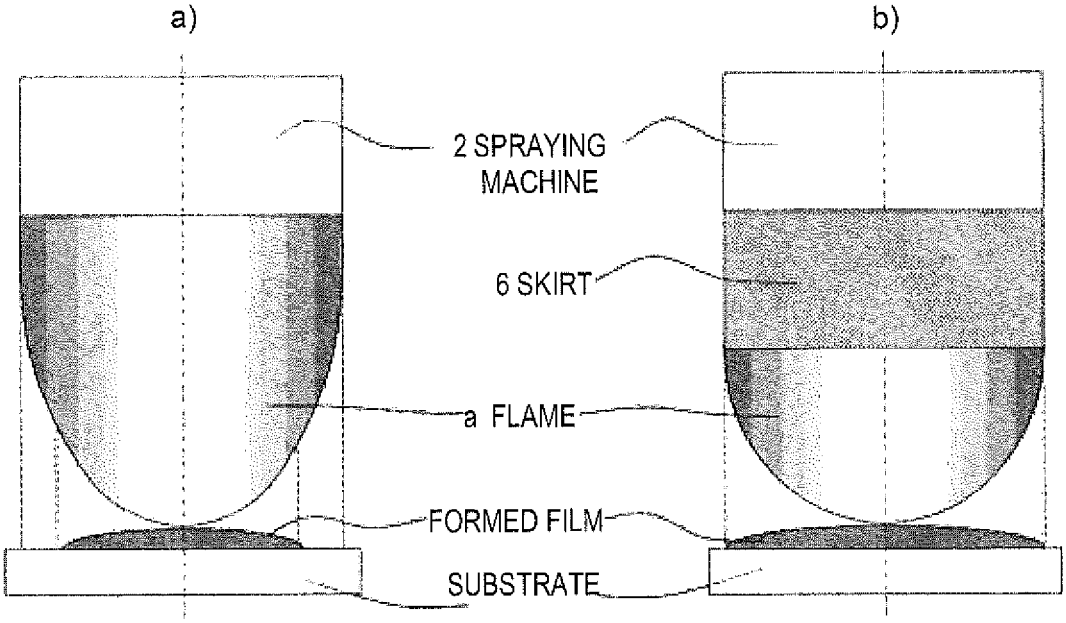
FIG. 10 shows the difference of film width and film thickness deviation between the cases when the spraying machine has no skirt (FIG. 10(*a*)) and has a skirt (FIG. 10(*b*)) at the front side thereof.

When the skirt 6 is provided on the front part of the spraying machine 2 so as to surround just outside the flame a and the inert gas b, the frame a is allowed to come in contact with air in a smaller area, thereby restraining the formed film from width narrowing and increase of a film thickness deviation (see Table 2), in comparison to the case without a skirt 6 (FIG. 10(*a*)).

TABLE 2

Table 2 Difference in film width and film thickness deviation depending on the presence or absence of the skirt

| | No Skirt | Skirt |
|---|---|---|
| Film width (mm) | 120 to 170 | 260 to 300 |
| Film thickness deviation (μm) | 80 to 120 | 30 to 80 |

DESCRIPTION OF LETTERS OR NUMERALS

1 Device for forming amorphous film
2 Spraying machine
3 Mist spraying nozzle
6 Skirt
11 Particulate material spraying ports
12 Flame spraying ports
13 Inert gas spraying ports
14 Mist spraying port

What is claimed is:

1. A device for forming amorphous film, which sprays a flame including a particulate material with a spraying machine toward a substrate, melts said particulate material with the flame, and cools said particulate material and said flame before said particulate material and said flame reach the substrate, wherein the spraying machine has a front face provided with a series of particulate material spraying ports and a series of flame spraying ports each placed along a straight line such that said flame including the particulate material has an oblong cross section; a series of spraying ports of an inert gas for rectification and cooling of the flame is placed along said straight line on said front face of the spraying machine, on both sides across all of said series of particulate material spraying ports and said series of flame spraying ports; and a series of spraying ports of a mist for cooling of the flame is placed along said straight line, on both sides across all of said series of particulate material spraying ports, said series of flame spraying ports, and said series of inert gas spraying ports, and the series of particulate material spraying ports is structured by successively disposed particulate material spraying ports, which are symmetrical about a virtual plane located on a center of the spraying machine at right angles to said straight line; and the particulate material is fed to the particulate material spraying ports from a plurality of supply pipes through branched passages, the supply pipes being capable of adjusting each of the particulate material supply and a carriage gas flow rate, the branched passages being symmetrically formed about said virtual plane and having an equal passage length from a common header formed from said supply pipes to each of the particulate material spraying ports, wherein each branched passage of the branched passages is connected to the common header and branches to form additional passages to the particulate material spraying ports in a way such that the particulate material is able to flow from the common header to each particulate supply ports through the same length, wherein said series of spraying ports of the inert gas is configured in a way such that the inert gas is sprayed just outside a flame generated by the series of flame spraying ports from the front face of the spraying machine and wherein said series of spraying ports of the mist are configured in a way such that the mist is sprayed outside the sprayed inert gas, wherein a skirt that is rectangular and extends to a forward position of the spraying machine is provided continuously just outside a position of the flame and the inert gas, said skirt being configured to be able to restrain film width narrowing and increase in film thickness deviation despite the flame having an oblong cross section, and the device or the substrate is able to transfer at a right angle to a longitudinal direction of the oblong cross section of the flame to form a wide and homogenous amorphous film on the substrate at a spraying distance of between 400 mm and 600 mm.

2. The device for forming amorphous film according to claim 1, wherein the series of mist spraying ports is set at an angle such that a sprayed mist approaches said flame; and said angle is able to be changed.

3. The device for forming amorphous film according to claim 2, wherein a spray pressure of said inert gas and a spray pressure of said mist are able to be changed respectively.

4. The device for forming amorphous film according to claim 1, wherein said inert gas and said mist are able to be sprayed so as to cool the flame including the particulate material at a rate of 400,000 to 1,000,000° C./s.

5. The device for forming amorphous film according to claim 1, wherein the series of mist spraying ports is provided as a slit aperture extending along said straight line.

6. The device for forming amorphous film according to claim 1, wherein said flame including the particulate material has a cross section of 150 mm or more in longitudinal length, and said series of inert gas spraying ports and said series of mist spraying ports each formed along said straight line are also 150 mm or more in length.

7. The device for forming amorphous film according to claim 1, wherein the particulate material spraying ports have different sizes.

8. The device for forming amorphous film according to claim 1, wherein the branched passages have different inner diameters.

9. The device for forming amorphous film according to claim 1, wherein the supply pipes, before reaching the common header, are also formed symmetrically about the virtual plane.

10. The device for forming amorphous film according to claim 1, wherein the particulate material is injected uniformly in any part of the cross section of the flame.

11. The device for forming amorphous film according to claim 1, wherein the mist is a water mist that is sprayed in a way such that the amount of oxygen sprayed from the flame spraying ports is 50 to 80% of oxygen requirements for complete combustion.

12. The device for forming amorphous film according to claim 1, wherein the skirt comprises a channel for the series of spraying ports of the mist.

13. The device for forming amorphous film according to claim 1, wherein said series of spraying ports of the mist are configured to spray the mist at an open end of the skirt outside the sprayed inert gas to cool the flame before the flame reaches the substrate.

* * * * *